US007315124B2

(12) United States Patent
Kwon

(10) Patent No.: US 7,315,124 B2
(45) Date of Patent: Jan. 1, 2008

(54) PLASMA DISPLAY PANEL

(75) Inventor: Jae-Ik Kwon, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 11/127,147

(22) Filed: May 12, 2005

(65) Prior Publication Data

US 2005/0253515 A1 Nov. 17, 2005

(30) Foreign Application Priority Data

May 13, 2004 (KR) ..... 10-2004-0033806

(51) Int. Cl.
*H01J 17/49* (2006.01)

(52) U.S. Cl. ..... 313/587; 313/582

(58) Field of Classification Search ..... 313/582–587; 315/169.4; 345/37, 40, 60; 445/23–25
See application file for complete search history.

(56) References Cited

U.S. PATENT DOCUMENTS 3,801,851 A * 4/1974 Andoh et al. ..... 313/586
6,262,532 B1 * 7/2001 Park et al. ..... 313/585
6,548,957 B1 * 4/2003 Kim et al. ..... 313/585
2002/0089292 A1 * 7/2002 Ahn ..... 315/169.3
2003/0155862 A1 * 8/2003 Shirozu ..... 313/582

FOREIGN PATENT DOCUMENTS

KR 1020020027944 * 6/2000

OTHER PUBLICATIONS

Naoya Kikuchi, et al., "Development of New Structure AC-PDP Using Thick Film Ceramic Sheet Technology", IMID '03 Digest, 2003, pp. 401-406.

* cited by examiner

*Primary Examiner*—Joseph L Williams
(74) *Attorney, Agent, or Firm*—H.C. Park & Associates, PLC

(57) ABSTRACT

A plasma display panel including a front substrate, a rear substrate opposing the front substrate, a plurality of discharge cells between the front substrate and the rear substrate, first and second discharge electrodes opposing each other in the discharge cells, dielectric layers for covering the first and second discharge electrodes, address electrodes extending in a direction intersecting the first and second discharge electrodes, auxiliary discharge electrodes spaced apart from the address electrodes and extending in a direction intersecting the first and second discharge electrodes.

20 Claims, 7 Drawing Sheets

PLASMA DISPLAY PANEL

CROSS REFERENCE TO RELATED APPLICATION

This application claims priority to and the benefit of Korean Patent Application No. 10-2004-0033806, filed on May 13, 2004, which is hereby incorporated by reference for all purposes as if fully set forth herein.

BACKGROUND OF THE INVENTION

1. Field of the Invention

The present invention relates to a plasma display panel (PDP), and more particularly, to a PDP with improved discharge stability.

2. Discussion of the Background

Recently, plasma display apparatuses have become increasingly popular. Such display apparatuses have excellent characteristics such as high image quality and a wide viewing angle. Additionally, the display apparatuses may be thin and lightweight, and they can be simply manufactured to have large-sized screens. Therefore, they are being considered a next-generation large-sized flat display apparatus.

Plasma display panels (PDP) may be classified as direct current (DC) PDPs, alternating current (AC) type PDPs, and hybrid PDPs depending on applied discharge voltage characteristics. PDPs may also be divided into opposed discharge PDPs and surface-discharge PDPs depending on the discharge electrode structures. An AC PDP having a three-electrode surface-discharge structure has been typically employed.

FIG. 1 shows a conventional AC PDP 100 having a three-electrode surface-discharge structure.

Referring to FIG. 1, the PDP 100 includes an upper plate 110 and a lower plate 120.

The upper plate 110 may include a front substrate 111, common electrodes 112, which may be formed on a lower surface of the front substrate 111, scanning electrodes 113, which form discharge gaps in cooperation with the common electrodes 112, a first dielectric layer 114 covering the common electrodes 112 and the scanning electrodes 113, and a protective layer 115 covering the first dielectric layer 114.

The lower plate 120 may include a rear substrate 121, address electrodes 122, which may be disposed on the rear substrate 121 extending in a direction intersecting the common electrodes 112 and the scanning electrodes 113, a second dielectric layer 123 covering the address electrodes 122, partition walls 128, which are formed on an upper surface of the second dielectric layer 123 and define discharge spaces 125, fluorescent layers 126 formed inside discharge cells 125, and a discharge gas (not shown) filled within the discharge cells 125.

In the conventional three-electrode surface-discharge PDP 100 of FIG. 1, the scanning and common electrodes 113, 112, the first dielectric layer 114, and the protective layer 115 absorb about 40% of the otherwise visible light emitted from the discharge cell, thereby decreasing luminous efficiency.

A technology, developed by Noritake Co., Ltd, Japan, for overcoming this problem is disclosed in the 2003 Digest of the International Meeting on Information Display and Exhibition (IMID'03 DIGEST), pages 401-406. A pair of discharge electrodes may be disposed opposite to each other in a discharge cell in order to increase an opening ratio of the front substrate and increase a discharge area and discharge efficiency by the opposing discharge.

However, since the discharge electrodes may be disposed relatively far away from each other, a higher discharge voltage may be required and the discharge stability may deteriorate.

SUMMARY OF THE INVENTION

The present invention provides a PDP having improved discharge stability.

Additional features of the invention will be set forth in the description which follows, and in part will be apparent from the description, or may be learned by practice of the invention.

The present invention discloses a PDP including a front substrate, a rear substrate opposing the front substrate, and a plurality of discharge cells between the front substrate and the rear substrate. First and second discharge electrodes oppose each other in the discharge cells, and dielectric layers cover the first and second discharge electrodes. Address electrodes extend in a direction intersecting the first and second discharge electrodes, and auxiliary discharge electrodes, which extend in a direction intersecting the first and second discharge electrodes, are spaced apart from the address electrodes.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Figure 1:
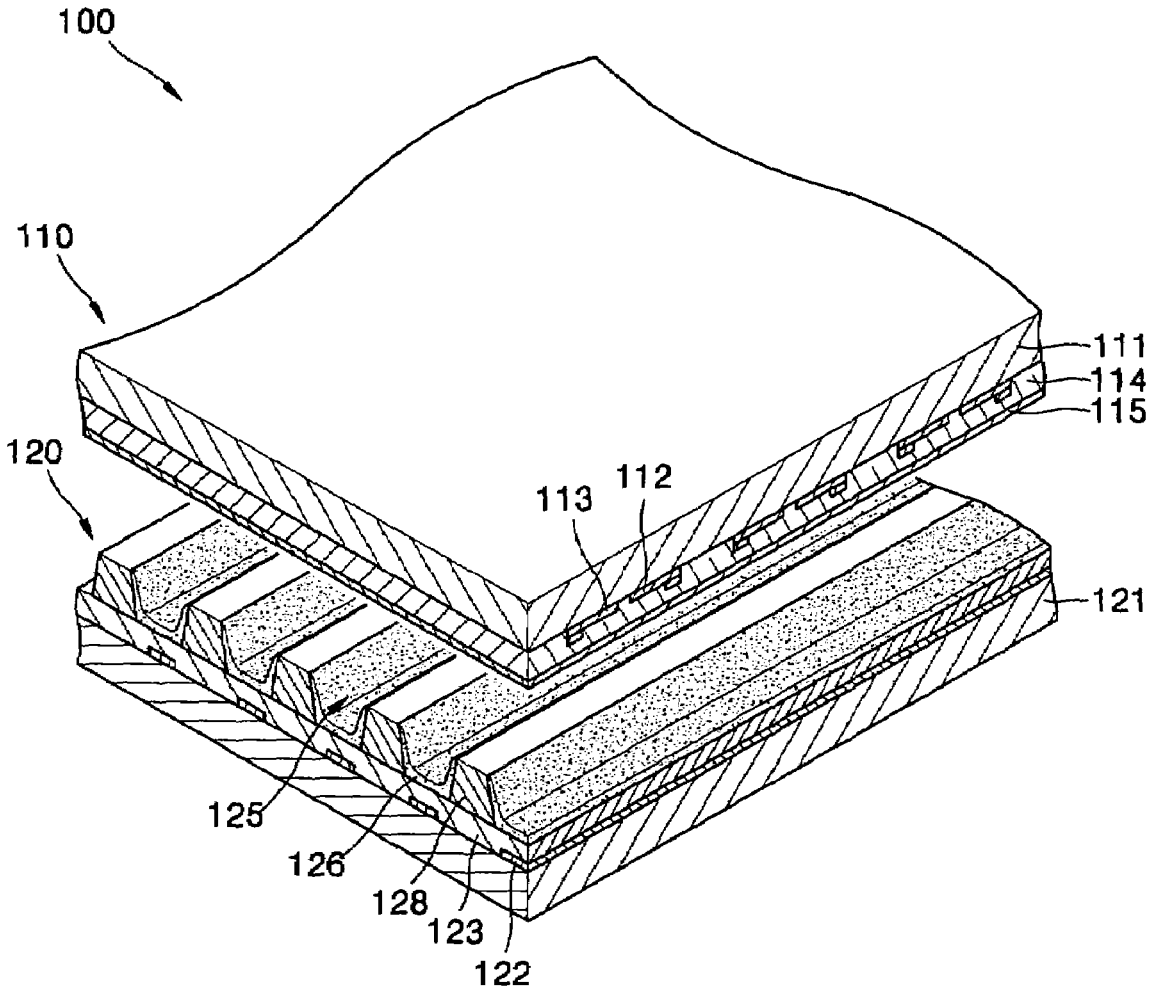
FIG. 1 (PRIOR ART)
FIG. 1 is an exploded perspective view showing a conventional PDP.

Hereinafter, a PDP 200 according to an exemplary embodiment of the present invention will be described in detail with reference to FIG. 2, FIG. 3, FIG. 4, FIG. 5, FIG. 6, FIG. 7, FIG. 8 and FIG. 9.

Referring to FIG. 2, FIG. 3, FIG. 4 and FIG. 5, the PDP 200 may include a front substrate 201, a rear substrate 202, which is disposed opposing the front substrate 201, and first and second discharge electrodes X and Y, which are disposed opposing each other facing toward the inside of the discharge cells 220. Address electrodes 203 may be formed extending in a direction intersecting the first and second discharge electrodes X and Y, and first and second dielectric layers 208*a* and 208*b* may cover the first and second discharge electrodes X and Y, respectively. Auxiliary discharge electrodes 207*a*, 207*b*, 207*c*, and 207*d* may extend in a direction intersecting the first and second discharge electrodes X and Y. Fluorescent layers 210 may be disposed in the discharge cells 220, and a discharge gas (not shown) may be filled within the discharge cells 220.

In the present embodiment, since visible rays generated in the discharge cells 220 travel through the front substrate 201, the front substrate 201 may be made of material such as, for example, glass, which has excellent light-transmittance. Unlike the conventional PDP of FIG. 1, the front substrate 201 does not include electrodes. Thus, the transmittance of visible rays toward the front side may significantly improve. Therefore, when displaying images at the same brightness level as in a conventional PDP, the discharge electrodes may be driven at a relatively lower voltage, thereby improving luminous efficiency.

A plurality of discharge cells 220, in which plasma discharge is generated, are formed between the front substrate 201 and the rear substrate 202. Each discharge cell 220 may be either a red, green, or blue sub-pixel. Partition walls 205 may be disposed between the front substrate 201 and the rear substrate 202 to partition the discharge cells 220 and to prevent a miss-discharge such as a cross-talk, which may occur between adjacent discharge cells 220.

Figure 2:
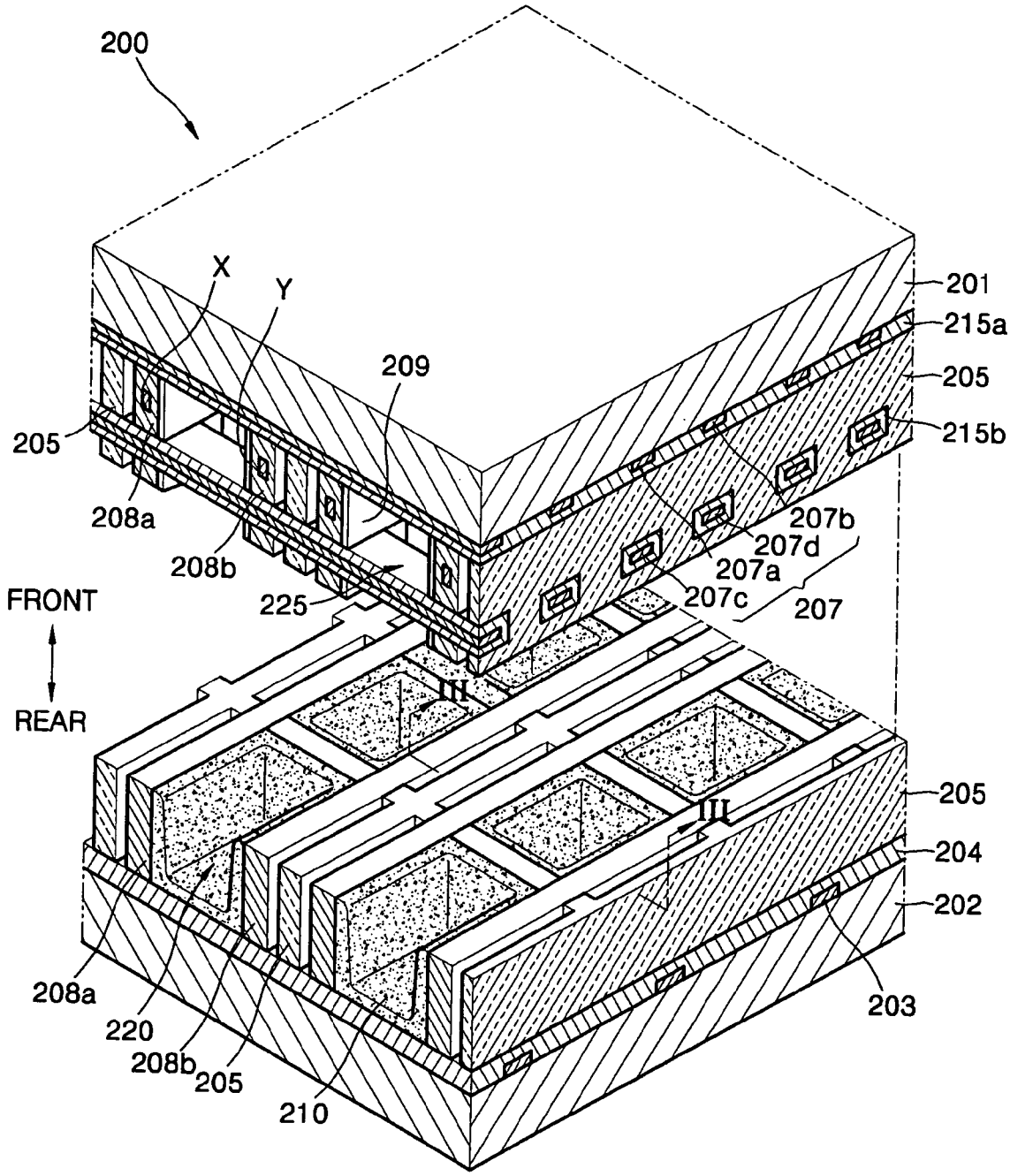
FIG. 2 is a cut away perspective view showing a PDP according to an exemplary embodiment of the present invention.

FIG. 2 shows the partition walls 205 partitioning the discharge cells 220 in a matrix shape, but the present invention is not limited to this shape. Rather, the partition walls 205 may define the discharge cells 220 in various closed and open shapes, such as, for example, closed shapes including waffle, matrix, delta, etc., and an open shape, such as stripes.

Figure 3:
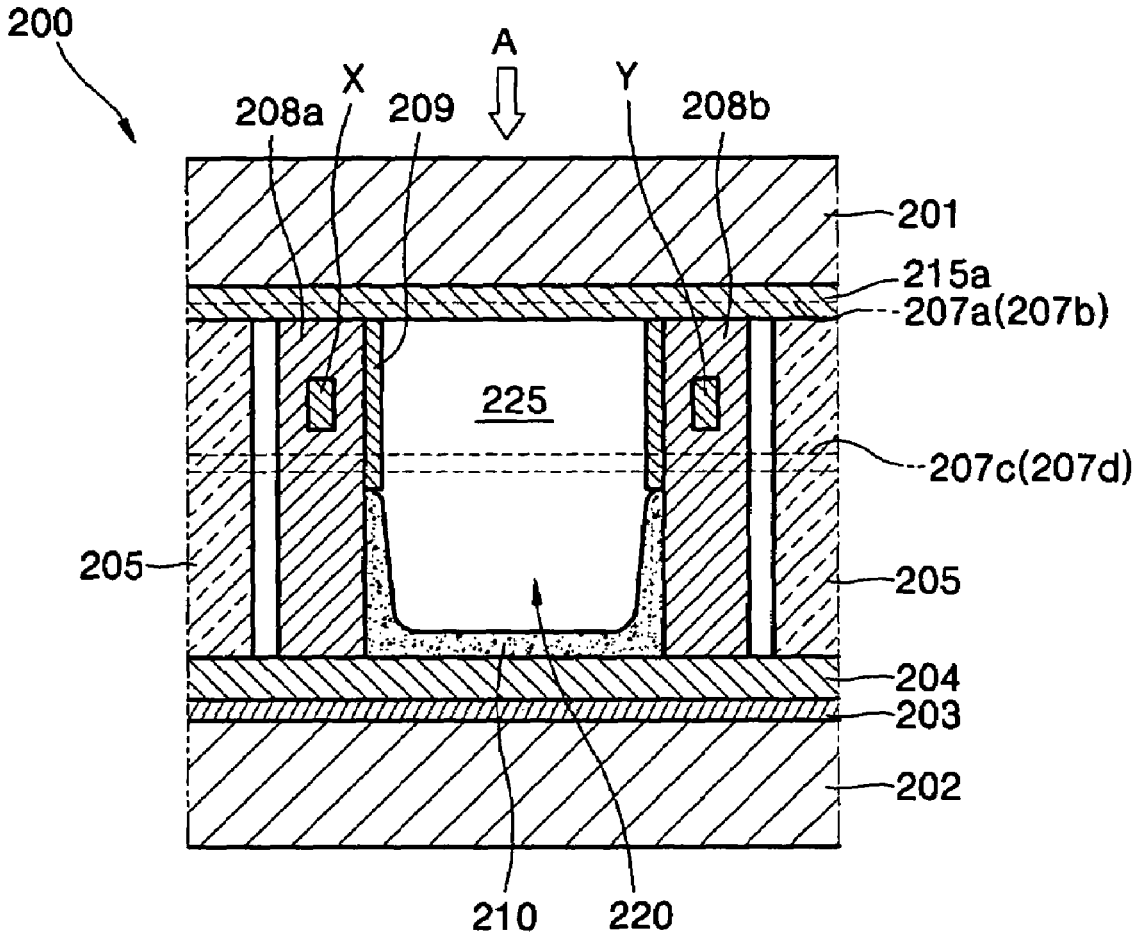
FIG. 3 is a sectional view taken along line III-III of FIG. 2.

The first and second dielectric layers 208*a* and 208*b*, which extend across the discharge cells 220 and which are disposed opposing each other, are formed in discharge cells 220. The first and second dielectric layers 208*a* and 208*b* may be symmetrically formed in each discharge cell 220, and they define electric-field concentration portions 225, along with dielectric layers 215*a* and 215*b*. Further, as FIG. 2 and FIG. 3 show, the first and second dielectric layers 208*a* and 208*b* may have substantially the same height as the partition walls 205.

The electric-field concentration portions 225, which are defined by the first and second dielectric layers 208*a* and 208*b* and the dielectric layers 215*a* and 215*b*, are spaces where a plasma discharge generated by the first and second discharge electrodes X and Y, and the auxiliary discharge electrodes 207*a*, 207*b*, 207*c*, and 207*d*, is concentrated.

Figure 4:
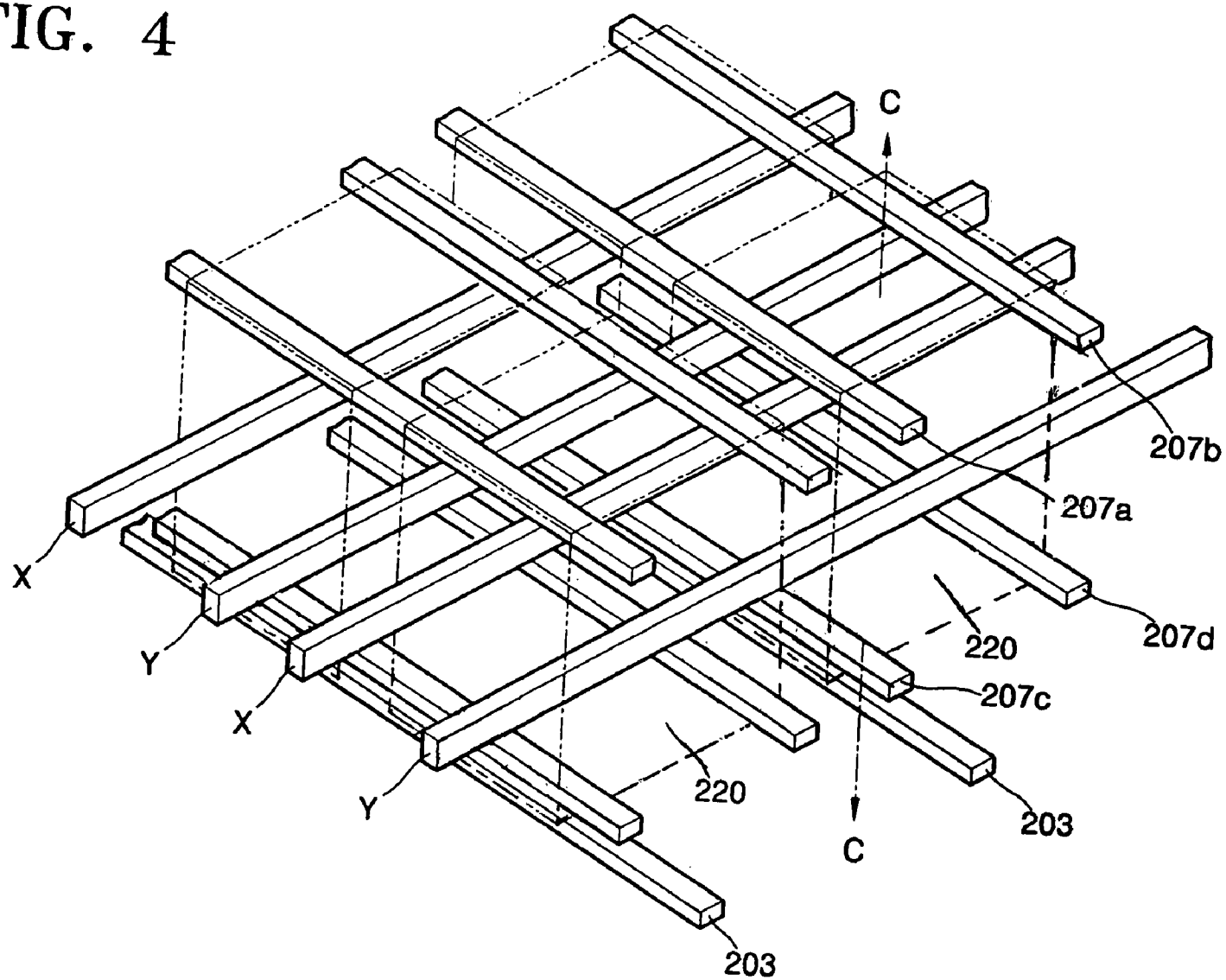
FIG. 4 shows an arrangement of discharge cells and electrodes of FIG. 2.

As FIG. 4 shows, the first and second discharge electrodes X and Y, which extend across the discharge cells 220, may be disposed inside the first and second dielectric layers 208*a* and 208*b*, respectively. The first and second discharge electrodes X and Y extend parallel to the front substrate 201. Further, the first and second discharge electrodes X and Y may be disposed opposing each other in the discharge cells 220, and they may be made of a conductive metal such as, for example, aluminium, copper, etc. Here, the first discharge electrodes X serve as common electrodes, and the second discharge electrodes Y serve as scanning electrodes.

The first and second dielectric layers 208*a* and 208*b* prevent charged particles from directly colliding with and damaging the first and second discharge electrodes X and Y. The first and second dielectric layers 208*a* and 208*b* may be made of a dielectric substance such as, for example, PbO, $B_2O_3$, $SiO_2$, etc., which can store wall charges by inducing the charged particles.

In the present embodiment, the first and second dielectric layers 208*a* and 208*b* are shown spaced apart from the partition walls 205 toward the insides of the discharge cells 220, but the present invention is not limited to this structure. For example, the first and second discharge electrodes X and Y may be disposed on side surfaces of the partition walls 205. In this case, the first and second dielectric layers 208*a* and 208*b* may be formed on the side surfaces of the partition walls 205, and they may cover the first and second discharge electrodes X and Y. Alternatively, the partition walls 205 may be omitted, and the first and second dielectric layers 208*a* and 208*b* may be formed in a predetermined shape to prevent cross-talk between adjacent discharge cells 220 and to partition the discharge cells 220.

Figure 5:
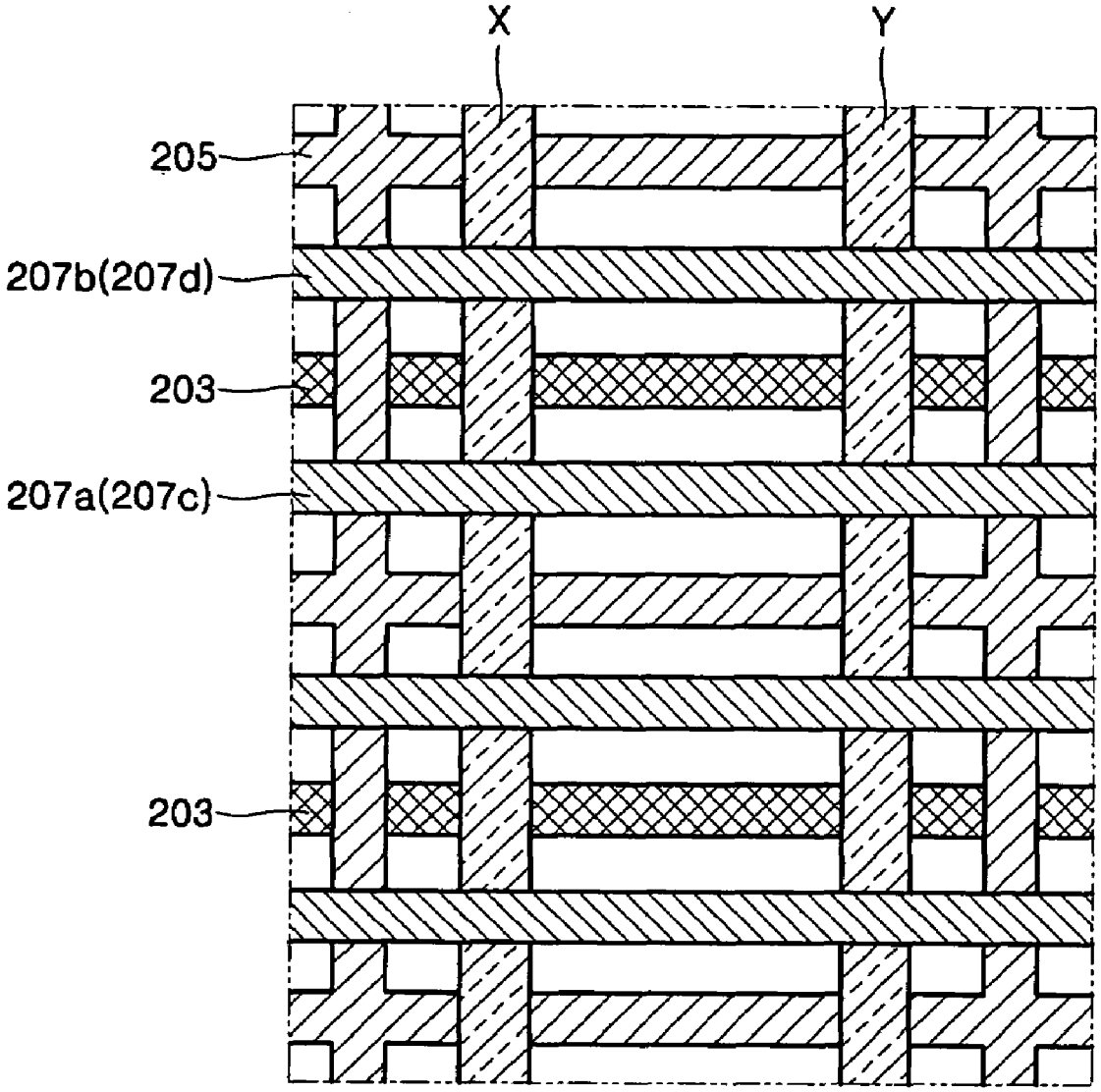
FIG. 5 is plan view taken along direction A of FIG. 3 showing partition walls and electrodes of the PDP of FIG. 2 and FIG. 3.

The PDP 200 may include auxiliary discharge electrodes. For example, the auxiliary discharge electrodes 207*a*, 207*b*, 207*c*, and 207*d* may connect the first and second dielectric layers 208*a* and 208*b*. Referring to FIG. 4 and FIG. 5, the auxiliary discharge electrodes 207*a*, 207*b*, 207*c*, and 207*d* traverse the discharge cells 220, extend in a direction intersecting the first and second discharge electrodes X and Y, and are spaced apart from the first and second discharge electrodes X and Y in a direction perpendicular to the front substrate 201. The auxiliary discharge electrodes 207*a*, 207*b*, 207*c*, and 207*d* are disposed to be symmetric with respect to imaginary center axes C-C of each discharge cell 220 in order to generate a uniform discharge in the discharge cells 220.

Here, the four auxiliary discharge electrodes 207*a*, 207*b*, 207*c*, and 207*d* may be disposed in each discharge cell 220. In this case, the auxiliary discharge electrodes 207*a* and 207*b* may be disposed between the first and second discharge electrodes X and Y and the front substrate 201, and the auxiliary discharge electrodes 207*c* and 207*d* may be disposed between the first and second discharge electrodes X and Y and the rear substrate 202. Further, the auxiliary discharge electrodes 207*a*, 207*b*, 207*c*, and 207*d* may be disposed adjacent to the partition walls 205 disposed at edges of the discharge cells 220. Therefore, the volume of the electric-field concentration portions 225 may increase. The number of auxiliary discharge electrodes and their arrangement are not limited to the number and arrangement mentioned above. For example, the auxiliary discharge electrodes may comprise electrodes 207*a* and 207*b* only, or they may comprise electrodes 207*c* and 207*d* only.

Dielectric layers 215*a* and 215*b* may cover the auxiliary discharge electrodes 207*a*, 207*b*, 207*c*, and 207*d* to prevent charged particles from damaging the auxiliary discharge electrodes. The dielectric layers 215*a* and 215*b* may be made of a dielectric substance such as, for example, PbO, $B_2O_3$, $SiO_2$, etc.

Side surfaces of the first and second dielectric layers 208*a* and 208*b*, which face the insides of the discharge cells 220, may be partially covered by a protective layer 209, such as, for example, an MgO protective layer. Specifically, the protective layer 209 may be formed on the side surfaces of the first and second dielectric layers 208*a* and 208*b*, which are adjacent to portions in which the first and second discharge electrodes X and Y are buried. The protective layer 209 prevents charged particles from colliding with and damaging the first and second dielectric layers 208*a* and 208*b*, and it emits secondary electrons during discharging.

The rear substrate 202 is disposed parallel to the front substrate 201, and it may be made of material including glass as a main component.

Further, the address electrodes 203, which may extend in a direction intersecting the first and second discharge electrodes X and Y, may be disposed on a surface of the rear substrate 202 facing the front substrate 201. The address electrodes 203 generate an address discharge, which facilitates a subsequent sustain discharge between the first and second discharge electrodes X and Y. Specifically, the address electrodes 203 may assist with lowering a sustain-discharge firing voltage. The address discharge occurs between a scanning electrode Y and an address electrode 203. The address discharge accumulates positive ions to the scanning electrode Y side and electrons to the common electrode X side, whereby the sustain discharge between the scanning electrodes Y and the common electrodes X can be easily generated.

A dielectric layer 204 covers the address electrodes 203, and it may be made of a dielectric substance such as, for example, PbO, $B_2O_3$, $SiO_2$, etc., which can prevent charged particles or the electrons from colliding with and damaging the address electrodes 203, as well as induce wall charges.

The fluorescent layers 210 can be disposed at various positions. In the present embodiment, as shown in FIG. 3, the fluorescent layers 210 may be coated on lower side surfaces of the first and second dielectric layers 208*a* and 208*b*, which face the insides of the discharge cells, and on the surface of the dielectric layer 204 facing the front substrate 201.

The fluorescent layers 210 receive ultraviolet rays and emit visible rays. The fluorescent layer 210 formed in red sub-pixels may include a fluorescent substance such as, for example, $Y(V,P)O_4$:Eu, etc., the fluorescent layers 210 formed in green sub-pixels may include a fluorescent substance such as, for example, $Zn_2SiO_4$:Mn, $YBO_3$:Tb, etc., and the fluorescent layers 210 formed in blue sub-pixels may include a fluorescent substance such as, for example, is BAM:Eu, etc.

A discharge gas such as, for example, Ne, Xe, etc., or a mixture thereof, may be filled within the discharge cells 220. According to exemplary embodiments of the present invention, since the discharge area can be increased and the discharge space can be enlarged, an amount of generated plasma may increase, which permits low-voltage driving.

The PDP 200 may utilize at least an address period and a sustain discharge period to display images.

In the address period, applying an address voltage between an address electrode 203 and a second discharge electrode Y generates an address discharge between these electrodes, thereby selecting the corresponding discharge cell 220 to be sustain discharged.

In the sustain discharge period, alternately applying a sustain discharge voltage between a first discharge electrode X and the second discharge electrode Y of the selected discharge cell 220 generates a sustain discharge between the first discharge electrode X and the second discharge electrode Y.

Figure 6:
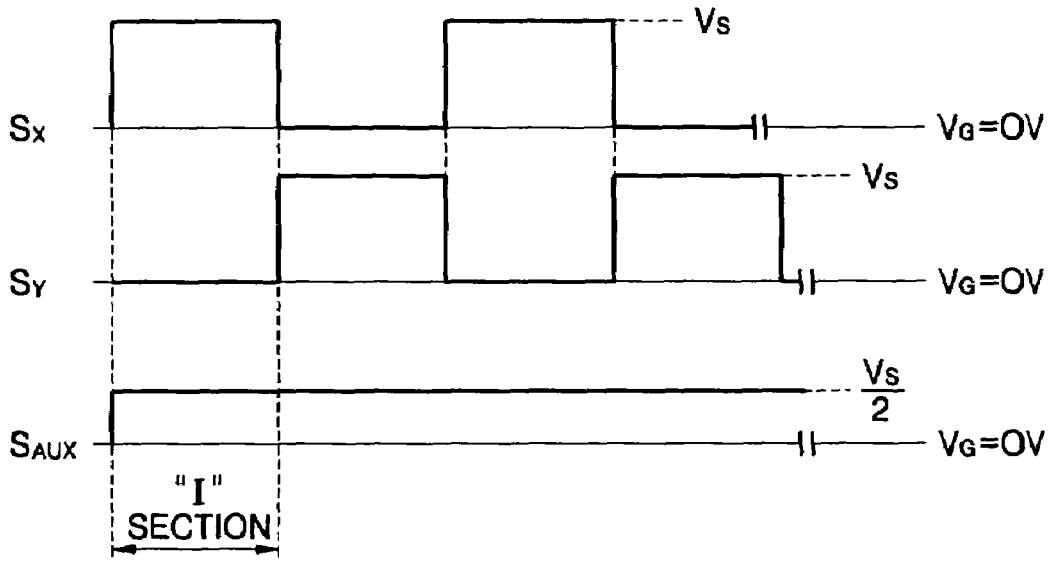
FIG. 6 is a diagram showing discharge waveforms that may be applied to electrodes of the PDP of FIG. 2.

FIG. 6 is a diagram showing discharge waveforms that may be applied to electrodes of the PDP 200 of FIG. 2, and FIG. 7, FIG. 8 and FIG. 9 are diagrams showing discharge characteristics resulting from applying the waveforms in section "I" of FIG. 6. Referring to FIG. 6, $S_X$, $S_Y$ and $S_{AUX}$ denote waveforms that may be applied to the X, Y and auxiliary discharge electrodes, respectively, during the sustain discharge period. A sustain discharge pulse $V_S$ may be alternately applied to the first and second discharge electrodes X and Y while biasing the auxiliary discharge electrodes at a voltage of $V_S/2$.

In section "I" of FIG. 6, the sustain voltage $V_S$ is applied to the first discharge electrodes X, and a ground voltage $V_G$ is applied to the second discharge electrodes Y. Hence, the first discharge electrodes X, with a relatively higher voltage, become (+) electrodes and the second discharge electrodes Y, with a relatively lower voltage, become (−) electrodes. An electric field is generated in the discharge cells 220.

Figure 7:
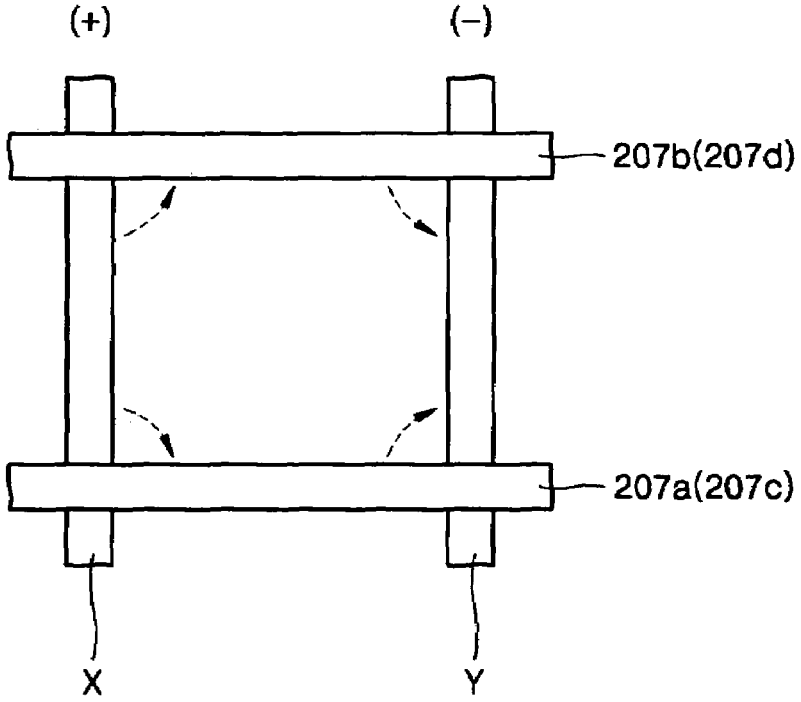
FIG. 7, FIG. 8 and FIG. 9 are diagrams showing discharge characteristics resulting from applying the waveforms in section "I" of FIG. 6.
Figure 8:
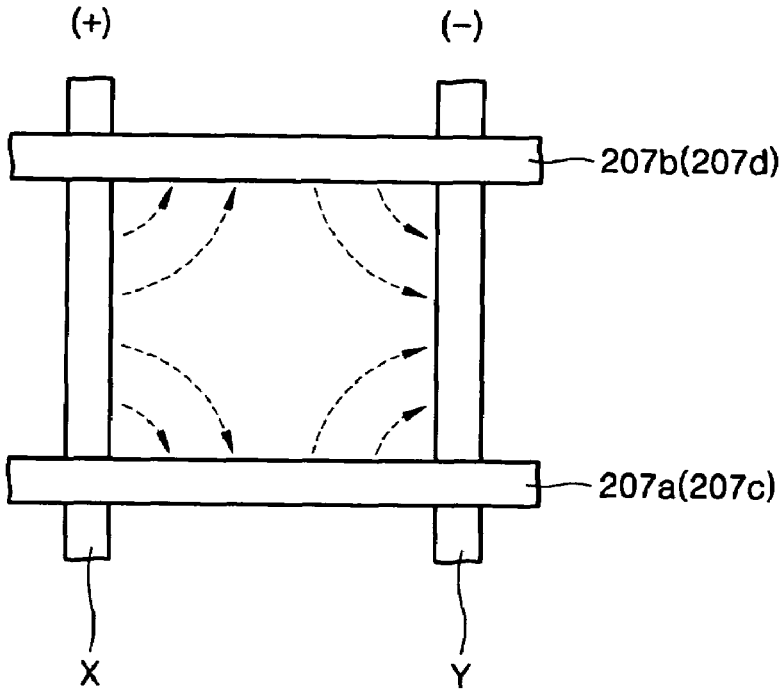
Figure 9:
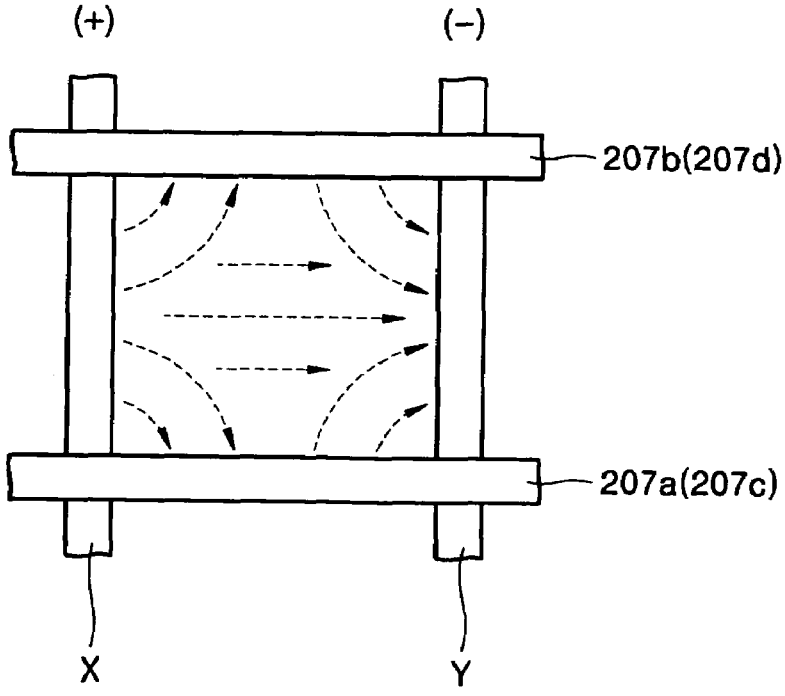

At this time, as FIG. 7 shows, a discharge firstly occurs adjacent to the auxiliary discharge electrodes 207*a*, 207*b*, 207*c*, and 207*d* and the first discharge electrodes X, and adjacent to the auxiliary discharge electrodes 207*a*, 207*b*, 207*c*, and 207*d* and the second discharge electrodes Y. Then, as FIG. 8 shows, the discharge spreads along the auxiliary discharge electrodes 207*a*, 207*b*, 207*c*, and 207*d*. Next, as FIG. 9 shows, the discharge spreads between the first discharge electrodes X and the second discharge electrodes Y. At this time, since sufficient charged particles are generated inside the discharge cells 220 and a discharge area increases, the discharge voltage decreases and the discharge can be stably performed.

Ultraviolet rays are emitted as the energy level of excited discharge gas decreases. The ultraviolet rays excite the fluorescent layers 210 coated inside the discharge cells 220, and the fluorescent layer 210 emits visible rays as its energy level decreases, thereby displaying images.

In the PDP according to exemplary embodiments of the present invention, since the sustain discharge starts between the first and second discharge electrodes and auxiliary discharge electrodes and then spreads between the first and second discharge electrodes, a discharge voltage decreases and discharge stability improves. Further, since the PDP has a substantially opposing discharge structure, discharge efficiency is improved and a discharge area increases. Furthermore, since electrodes are not disposed on the front substrate, the opening ratio increases, and luminous efficiency improves.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel (PDP), comprising:

a front substrate;

a rear substrate opposing the front substrate;

a discharge cell arranged between the front substrate and the rear substrate;

a first discharge electrode and a second discharge electrode both extending in a third direction and opposing each other in the discharge cell to generate a discharge therebetween;

a first dielectric layer and a second dielectric layer covering the first discharge electrode and the second discharge electrode, respectively;

an address electrode extending in a first direction intersecting the first discharge electrode and the second discharge electrode; and auxiliary discharge electrodes spaced apart from the address electrode and extending in a second direction intersecting the first discharge electrode and the second discharge electrode, wherein the second direction is not parallel to the third direction.

2. The PDP of claim 1, wherein the auxiliary discharge electrodes are disposed to be symmetric with respect to imaginary center axis of the discharge cell.

3. The PDP of claim 1, wherein the auxiliary discharge electrodes comprise first auxiliary discharge electrodes and second auxiliary discharge electrodes in the discharge cell.

4. The PDP of claim 3, wherein the auxiliary discharge electrodes are disposed between the first discharge electrode and the second discharge electrode and the front substrate.

5. The PDP of claim 3, wherein the auxiliary discharge electrodes are disposed between the first discharge electrode and the second discharge electrode and the rear substrate.

6. The PDP of claim 1, wherein the auxiliary discharge electrodes comprise a first auxiliary discharge electrode, a second auxiliary discharge electrode, a third auxiliary discharge electrode, and a fourth auxiliary discharge electrode in the discharge cell.

7. The PDP of claim 6, wherein the first auxiliary discharge electrode and the second auxiliary discharge electrode are disposed between the first discharge electrode and the second discharge electrode and the front substrate, and wherein the third auxiliary discharge electrode and the fourth auxiliary discharge electrode are disposed between the first discharge electrode and the second discharge electrode and the rear substrate.

8. The PDP of claim 1, wherein the auxiliary discharge electrodes are disposed adjacent to edges of the discharge cell.

9. The PDP of claim 1, wherein the second direction is substantially perpendicular to the first discharge electrode and the second discharge electrode.

10. The PDP of claim 1, wherein the auxiliary discharge electrodes are spaced apart from the first discharge electrode and the second discharge electrode toward the rear substrate.

11. The PDP of claim 1, further comprising a dielectric layer formed on the auxiliary discharge electrodes.

12. The PDP of claim 1, further comprising a dielectric layer covering the address electrode.

13. The PDP of claim 1, wherein the address electrode is disposed on a surface of the rear substrate facing the front substrate.

14. The PDP of claim 1, further comprising:

a first protective layer covering a portion of the first dielectric layer that covers the first discharge electrode; and a second protective layer covering a portion of the second dielectric layer that covers the second discharge electrode.

15. The PDP of claim 1, further comprising partition walls partitioning the discharge cell.

16. The PDP of claim 15, wherein the first dielectric layer and the second dielectric layer have substantially the same height as the partition walls.

17. The PDP of claim 1, further comprising a fluorescent layer covering a portion of the first dielectric layer and the second dielectric layer.

18. The PDP of claim 1, wherein a constant voltage is applied to the auxiliary discharge electrodes in a sustain discharge period.

19. The PDP of claim 1, wherein a voltage with half an amplitude of a sustain voltage that is applied to the first discharge electrode and the second discharge electrode is applied to the auxiliary discharge electrodes in a sustain discharge period.

20. The PDP of claim 1, wherein the first direction and the second direction are the same direction.

* * * * *